United States Patent [19]

Funkhouser

[11] 4,064,584

[45] Dec. 27, 1977

[54] UPPER BOAT DECK

[76] Inventor: James Harold Funkhouser, 933 Avenue H, Fort Madison, Iowa 52627

[21] Appl. No.: 722,781

[22] Filed: Sept. 13, 1976

[51] Int. Cl.[2] ..... B63B 3/48

[52] U.S. Cl. ..... 9/1.1; D12/67; 114/85

[58] Field of Search ..... 9/1.1, 1.5, 2 S, 6 P; 114/71, 77 R, 77 A, 85; D12/66, 67, 70

[56] References Cited

U.S. PATENT DOCUMENTS

| | | | |
|---|---|---|---|
| D. 221,702 | 8/1971 | Peterson | D12/70 |
| D. 235,320 | 6/1975 | Klingler | D12/67 |
| D. 242,848 | 12/1976 | Morrison et al. | D12/70 |

FOREIGN PATENT DOCUMENTS

| | | | |
|---|---|---|---|
| 1,180,107 | 2/1970 | United Kingdom | 9/1.5 |

OTHER PUBLICATIONS

"Trojan 34' Houseboat", Feb. 1970.
"Trojan Sea Voyagers for 1970", Trojan Yachts.
"The Waterfront Vacation Home You Can Take Along With You", Drift-R-Cruz.

*Primary Examiner*—Trygve M. Blix
*Assistant Examiner*—Charles E. Frankfort
*Attorney, Agent, or Firm*—Thomas E. Frantz

[57] ABSTRACT

The cabin of a boat is enclosed or covered by an upper sun deck having a relatively flat surface with two elongate recesses of a depth approximately equal to the height of a chair seat. One recess forms a walkway extending substantially the length of the flat surface along one side thereof, terminating at the stern end in an access opening and at the bow end in a transversely wider cockpit section. The other recess extends less than the length of the flat surface. The flat surface and recesses combine to provide a "table" area and comfortable seating for a plurality of passengers.

10 Claims, 5 Drawing Figures

UPPER BOAT DECK

BACKGROUND OF THE INVENTION

This invention relates generally to water craft, and more particularly to a boat having an upper or sun deck with unique structural features which permit both convenient movement and comfortable seating of passgengers thereon.

The roof of the usual houseboat or similar water craft serves simply as an enclosure or cover for the cabin. In some instances, the roof is formed to serve as an upper or sun deck on which passengers may recline for sunning or place chairs and/or tables for use in fishing, playing cards, conversing, and the like. United States Design Patent Nos. 202,150; 223,219; 227,509 and 235,320 are representative of a number of prior boat structures having such sun decks.

While these previous sun deck structures have proven desirable to the extent of providing more usable area on a boat, at the same time they have generated certain problems. For instance, chairs and tables must be carried back and forth between the cabin and sun deck should the passengers wish to sit comfortably while fishing, playing cards, conversing, etc. Such movement of furniture is not only inconvenient and potentially dangerous, particularly in the case of a small child or relatively weak person, but can lead to loss of furniture overboard as well as bunps and nicks on both the furniture and boat furnishings. Further, tables, chairs and similar loose deck furniture are subject to unexpected and dangerous sliding and tipping should the deck tilt to any great extent as a result of the action of wind gusts, waves or other similar forces on the boat.

Boats having an upper deck cockpit area with fixed or integral seats have been provided, as illustrated in a brochure published in 1969 by Trojan Yachts, Lancaster, Pennsylvania, entitled "The 1970 Trojan 34' Houseboat." In such boats, however, the cockpit obviously has no provision for an integral "table" surface. And the sun deck, per se, would still require the use of separate tables and chairs should passengers wish to sit comfortable thereon while fishing, card playing, conversing, etc.

Accordingly, while past developments in the boating field have provided cabin enclosures or covers which not only serve as sun decks but include fixed cockpit seating, such developments have not succeeded in eliminating the need for or dangers inherent in using separate furniture on such decks or the inconveniences attendent to the handling of such furniture.

SUMMARY OF THE INVENTION

This invention provides a boat in which a cabin cover or enclosure simultaneously serves not only as a sun deck but provides integral table, seating and walkway facilities. In its preferred form, the invention is embodied in a small or medium size water craft such as a family or pleasure type houseboat having a hull, a lower deck and a cabin disposed on the deck. An upper deck is provided as a cover or enclosure for the cabin, this upper deck preferably being formed as a single piece from an inert, weather and water resistant material such as a fiberglass reinforced synthetic resin. Defined by the upper deck is a substantially planar upper surface and an elongate recessed walkway extending along one side of the upper surface substantially its full length. The forward or bow end of the walkway terminates in a transversely wider cockpit section, and the rearward or stern end terminates in an access opening through which passengers may climb to reach or leave the upper deck. An upwardly inclined support surface may be provided forwardly of the upper surface for use in sun bathing. Also, a second recess may be formed along the other side of the upper surface. Thus, passengers may comfortably sit along both sides of the upper surface with their feet disposed in the recesses. If facing outwardly of the boat, as in fishing, the passengers obviously would sit on the center portion of the upper surface. If playing cards, conversing, etc., however, they would sit on the upper surface outwardly of the recesses, thereby using this center portion as a table surface for holding cards, glasses, papers, and the like.

Accordingly, it is an object of the present invention to provide an improved water craft.

Another object of this invention is the provision of a boat of the houseboat or pleasure type, having an improved sun or upper deck.

Yet another object of this invention is to provide a houseboat having a cabin covered by a single piece sun or upper deck which includes integral walkway, table and seating facilities.

A still further object of this invention is the provision of a sun or upper deck for a houseboat, or the like, the deck including transversely spaced areas which are recessed to a depth approximately equal to the height of a chair, there being a table area between the recesses.

Yet a further object of this invention is to provide a sun or upper deck for a houseboat, or the like, which provides both seating and table facilities without requiring the use of separate furniture.

Yet another object of this invention is the provision of a houseboat which is of improved safety and convenience.

Still further and additional objects of the present invention will become apparent from the following specification and claims when considered in connection with the appended drawings.

DESCRIPTION OF THE PREFERRED EMBODIMENT

Figure 1:
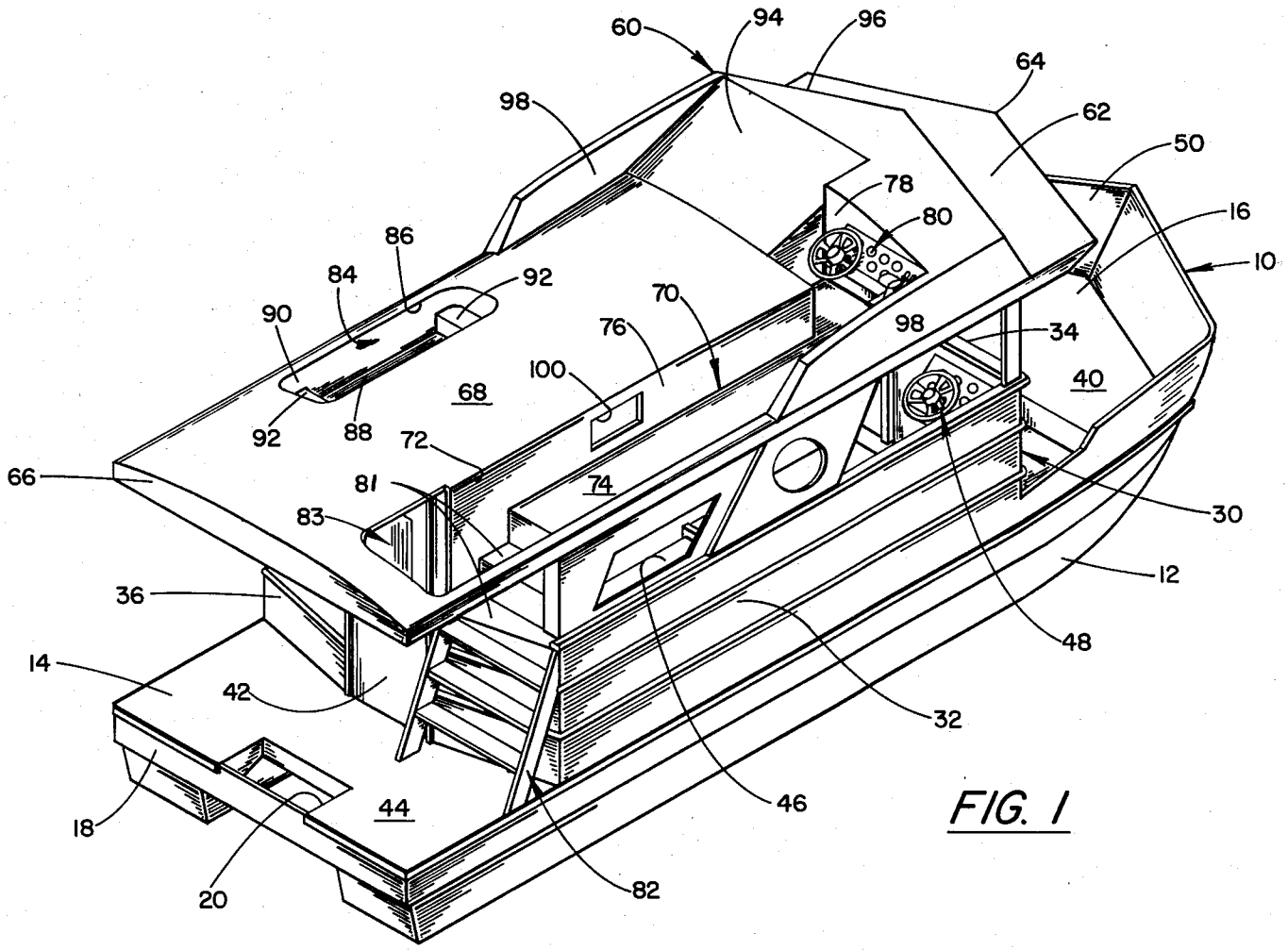
FIG. 1 is a perspective view of a houseboat embodying the present invention.

Referring first to FIG. 1 of the drawings, the preferred embodiment is illustrated in the form of a houseboat 10 having a hull 12 and a lower deck 14. The hull 12 and lower deck 14 are generally conventional in configuration and construction, having a pointed bow 16 and a substantially flat stern 18. Extending through deck 14 adjacent the stern 18 is a centrally located aperture 20 through which the shaft of an outboard motor (not illustrated) is adapted to extend for purposes of propelling the boat 10.

A cabin 30 is provided on the lower deck 14, the cabin including side walls 32, a forward wall 34 spaced from the bow 16, and a back wall 36 spaced from the stern 18. Included in forward wall 34 is a door 38 (See FIG. 5) leading to an open forward deck area 40. A second door 42 is provided in back wall 36 to provide access between the cabin 32 and the open rearward deck area 44.

Figure 5:
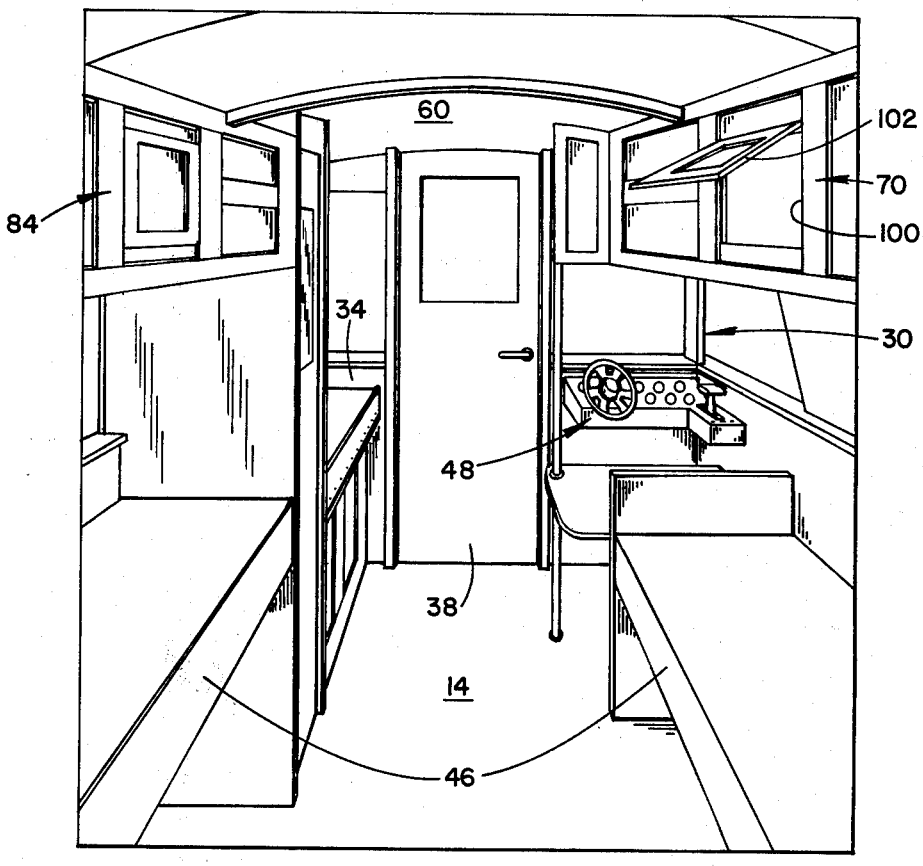
FIG. 5 is a view, in perspective, of the interior of the cabin of the houseboat as shown in FIG. 1, the view being taken from the stern end of the cabin.

Referring particularly to FIG. 5, it will be noted that internally, the cabin is provided with various appointments and equipment such as bunks or seats 46, tables, a control panel 48, and the like. As the interior arrangement of the cabin is not part of the present invention, however, such appointments and equipment will not be discussed in detail.

Referring again to FIG. 1, it will be noted that the lower portion of side walls 32 of cabin 30 are extended forwardly around the bow 16 to provide a guard rail 50 for the protection of passengers. In addition, other guard rails normally would be used around open rearward deck area 44, but since such rails are not part of the present invention, they are not illustrated or described herein. The same is true with respect to various guard rails which normally would be provided on the upper deck to be described hereinafter.

While believed obvious to those skilled in the art, it should be pointed out that the particular configuration of and materials used in fabricating hull 12, lower deck 14 and cabin 30 may be varied to accommodate the handling characteristics desired in the finished boat 10, and available materials. For example, although wood or metal such as aluminum may be used in fabricating these components, a fiberglass reinforced synthetic resin generally is preferred. Experience has shown that fiberglass reinforced polyester plastic will not only provide excellent appearance and high resistance to damage and degradation upon long exposure to the elements, but can be fabricated readily using relatively inexpensive molds and simple hand lay-up or spray-up methods well known in the boat industry.

Suitably supported over and attached to cabin 30 is an upper deck 60 which preferably is formed as a single piece component of a fiberglass reinforced plastic. As pointed out above, the specific methods and materials used to fabricate such parts are so well known in the industry that any detailed discussion thereon would appear to be unnecessary in this application.

As will be noted particularly from FIG. 1 of the drawings, upper deck 60 is of about the same width as but projects beyond the bow and stern ends of cabin 30. To blend into the overall basic design of the boat 10, the bow end 62 of deck 60 tapers to a centrally disposed point 64, with the stern end thereof terminating in a substantially straight rearward edge 66.

Figure 2:
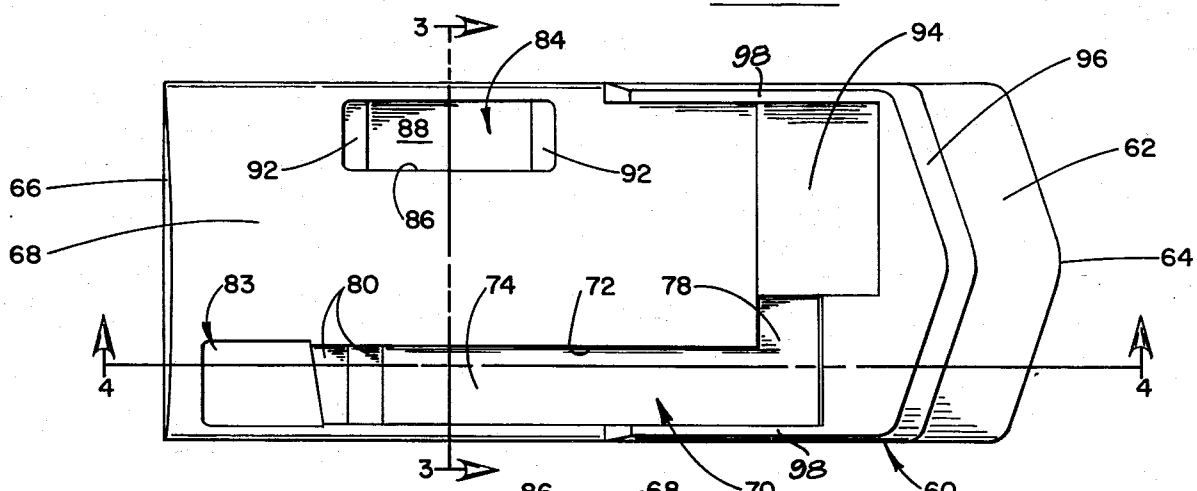
FIG. 2 is a top plan view of the sun or upper deck only of the houseboat as shown in FIG. 1.
Figure 3:
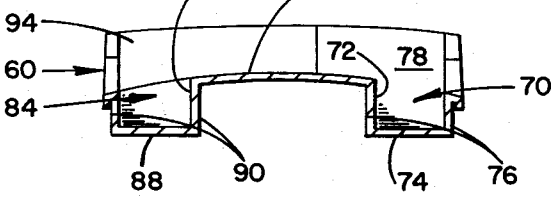
FIG. 3 is a transverse sectional view of the sun or upper deck as taken on the line 3—3 of FIG. 2.
Figure 4:
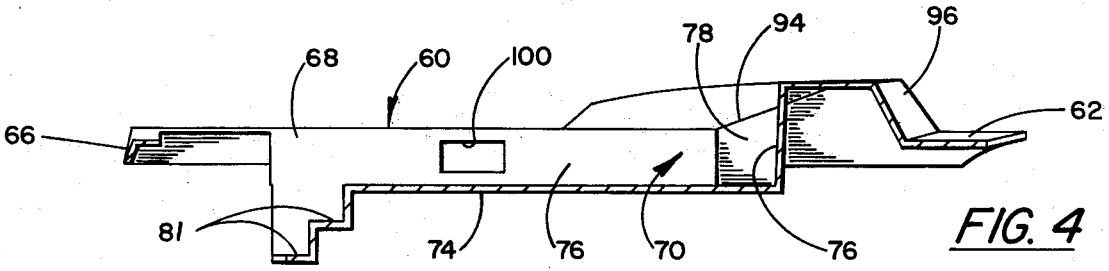
FIG. 4 is a longitudinal sectional view of the sun or upper deck as taken on the line 4—4 of FIG. 1.

Calling attention now to FIGS. 2, 3 and 4, deck 60 includes an upper surface 68 which, while substantially planar, has a slight convex arc to insure good water drainage therefrom in the event of rain or spray. This surface 68 extends from the rearward edge 66 forwardly for about three-fourths of the length of deck 60.

Spaced inwardly a short distance from the starboard side of deck 60 is a recessed walkway 70 which extends substantially the full length of upper surface 68. This walkway 70 is defined by an elongate aperture 72 formed in surface 68, there being a substantially planar lower surface 74 of the same size and shape as aperture 72 and forming a floor for the walkway 70. Connecting upper and lower surfaces 68 and 74 and integral therewith are side surfaces 76.

Adjacent to the forward end of walkway 70, its width is increased toward the center of boat 10 to form a cockpit area 78 fitted with a control panel 80 which duplicates the control panel 48 provided within cabin 30. Thus, control of the boat may be handled either from cabin 30 or upper deck 60.

The lower surface 74 is shorter than aperture 72, terminating at the rearward or stern end 36 of cabin 30 in a pair of stair steps 81. These steps match those of ladder 82, which is suitably affixed to cabin 30 to permit easy access between lower deck 14 an upper deck 60 through access opening 83.

Adjacent to the port side of upper surface 68 is an elongate recessed well 84. This well is defined by a second elongate, longitudinally positioned aperture 86, a second planar lower surface 88 depending from aperture 86, and a second set of side walls 90 connectively supporting surfaces 68 and 88. Positioned at each end of well 84 is a step 92 to permit easy and convenient access into the well.

Walkway 70 and well 84 should be about equal to each other in depth, depending below surface 68 a distance approximately equal to the height of a chair seat. This may vary anywhere between about 14 and about 18 inches, but preferably it should run about 15 to about 17 inches. By use of this depth, an average person may sit comfortably for long periods on upper surface 68 merely by placing his legs in either the walkway or well and his feet on the lower surface 74 or 88.

In width, walkway 70 and well 84 should measure no less than about 12 inches to accommodate the shoe of the large person. Also, walkway 70 preferably should be somewhat wider to insure that one can walk therealong easily and conveniently.

As will be obvious from the drawings and preceding description, walkway 70 and well 84 may be used whether it is desired to face outwardly of the boat 10, as in fishing, or to face inwardly for playing cards or conversing with persons sitting on the other side of the deck. It would merely be necessary to sit on the upper surface 68 adjacent to the appropriate side of walkway 70 or well 84. One particularly interesting feature of the embodiment above described is the convenience of sitting in the control cockpit 78 facing forwardly to insure good visibility in handling the boat 10.

A support surface 94 extends forwardly and slopes upwardly from upper surface 68 to provide an area on which one might recline for sun bathing purposes. This support surface 94 terminates at its bow end in a raised wind-shield like member 96 which extends across upper deck 60 immediately in front of cockpit area 78. Projecting back from windshield 96 along each edge of deck 60 is a side shield 98 to help guard against inadvertent entry of spray onto upper deck 60.

Guard rails (not illustrated) preferably may be provided along the back and sides of upper deck 60 to assist in preventing loss of persons overboard in the event the boat should be struck by an unexpected wind gust or waves. Also, such rails would assist one in traversing along walkway 70 between access opening 83 and cockpit area 78.

As best illustrated in FIG. 5, both walkway 70 and well 84 depend into cabin 30 along each side thereof. Thus, while they would not interfere with the movement of persons within the cabin, they could be unattractive if not decorated to match the interior decor of the cabin. For this purpose, appropriately placed and finished paneling and trim may be placed on the interior surfaces of the walkway and well to simulate wall mounted cabinets. In addition, to provide ventilation and easy access between the cabin and the upper deck, there may be provided a passage 100 through one of the side surfaces 76. Within the cabin, a suitably hinged door 102 is provided to open and close passage 100.

As pointed out heretofore, this invention eliminates any need for passengers to carry tables and/or chairs back and forth to the upper deck 60 for use while sitting to fish, etc. And while this is a significant improvement because of the resultant absence of danger of damage to fittings on the boat or loss or damage of the furniture itself, other advantages will be apparent. Since there is no loose furniture on the upper deck, sliding and tipping of furniture is not a problem in the event tho boat tilts unexpectedly and severely upon being hit by a large wave or gust of wind. Further, the danger of capsizing is definitely reduced in the event of severe tilting, since passengers on the upper deck are somewhat closer to the ship's center of gravity if sitting at deck level rather than being elevated thereabove through use of separate chairs.

Although the preceding description and appended drawings are relatively detailed, it is to be understood that they are for the purpose of illustrating and not limiting the present invention, the scope of which is to be defined by the following claims:

I claim:

1. A boat having a hull, a lower deck supported on said hull, a cabin provided on said lower deck, and an upper deck disposed in a spaced generally parallel relationship with said lower deck, said upper deck projecting beyond the ends of and providing a cover for said cabin, said upper deck comprising an intergral one piece structure characterized by A. a substantially planar upper surface, B. a recessed walkway in and extending longitudinally substantially the length of said upper surface along one side thereof, a major portion of said walkway being of generally uniform width of no less than about 12 inches and substantially narrower than the width of said upper surface, said walkway being defined by i. an elongate aperture formed in and extending longitudinally substantially the length of said upper surface, ii. a planar lower surface disposed between about 12 and about 20 inches below and in a generally parallel relationship with said upper surface, and iii. side surfaces integral with and connectively supporting said upper and lower surfaces, C. said lower surface being shorter in length than said aperture and defining adjacent the stern end thereof rearwardly of said cabin an opening through said upper deck to provide access between said lower deck and said walkway, and D. means provided externally of said cabin for assisting one to climb between said lower and upper decks through said access opening.

2. A boat according to claim 1, characterized by the feature that adjacent the bow end thereof, said walkway is increased in width to provide a cockpit section.

3. A boat according to claim 2, characterized by the feature that said walkway extends along the starboard side of said upper deck and said cockpit area extends transversely therefrom toward the port side thereof.

4. A boat according to claim 3, characterized by the feature that said walkway depends within said cabin, said side surfaces including at least one passage providing communication between the interior of said cabin and said walkway.

5. A boat according to claim 4, characterized by a support surface extending forwardly and sloping upwardly from said upper surface, said support surface terminating at its bow end in a windshield portion which projects upwardly from said upper deck and extends transversely thereacross forwardly of said cockpit area.

6. A boat according to claim 5, characterized by an elongate recessed well in said upper surface, said recessed well being of about the same depth as said recessed walkway and defined by A. a second elongate aperture formed in and extending longitudinally of said upper surface adjacent the port side thereof, B. a second planar lower surface disposed below and in a generally relationship with said upper surface, and C. second side surfaces integral with and connectively supporting said upper and second lower surfaces.

7. A boat according to claim 6, characterized by a step provided within said recessed well at each end thereof to assist one in entering said well.

8. A boat according to claim 7, characterized by the feature that the depth of said walkway and said well ranges between about 14 inches and about 18 inches whereby one's feet are comfortably supported when sitting on said upper surface with the legs disposed in said walkway or well.

9. A boat according to claim 8, characterized by the features that said recessed well depends into said cabin.

10. A boat according to claim 9, characterized by the feature that said material comprises a substantially rigid synthetic resin having fibrous reinforcement embedded therein.

* * * * *